United States Patent [19]

Finkelstein

[11] 4,289,262

[45] Sep. 15, 1981

[54] STRUCTURE OF DISPENSER FOR DISPENSING WEB-LIKE MATERIAL

[76] Inventor: Oscar P. Finkelstein, 14/18 Ein Rogel St., Jerusalem, Israel

[21] Appl. No.: 66,064

[22] Filed: Aug. 13, 1979

[30] Foreign Application Priority Data

Aug. 23, 1978 [CH] Switzerland ..... 8917/78

[51] Int. Cl.[3] ..... B26F 3/02

[52] U.S. Cl. ..... 225/106; 221/63

[58] Field of Search ..... 225/12, 13, 106, 42; 221/55, 63; 206/409

[56] References Cited

U.S. PATENT DOCUMENTS

| | | | |
|---|---|---|---|
| 2,580,684 | 1/1952 | Lacy et al. | 225/42 |
| 2,657,873 | 11/1953 | Dittman et al. | 225/42 X |
| 2,695,208 | 11/1954 | Graham | 225/42 X |
| 3,269,593 | 8/1966 | Lodewick et al. | 221/63 |
| 3,606,080 | 9/1971 | Lynch et al. | 221/63 |
| 3,780,908 | 12/1973 | Fitzpatrick et al. | 221/63 X |
| 3,868,052 | 2/1975 | Rockefeller | 225/106 |
| 3,973,695 | 8/1976 | Ames | 221/63 |
| 3,982,659 | 9/1976 | Ross | 221/63 |

*Primary Examiner*—Frank T. Yost

*Attorney, Agent, or Firm*—Holman & Stern

[57] ABSTRACT

An aperture in a wall of a dispenser for dispensing tearable, web-like material, is provided. The aperture has the form of a slot, the active edges of which converge toward at least one end of the slot. Material drawn from said dispenser through the aperture and pulled toward the end is wedged tight between the converging slot edges and can be torn off.

14 Claims, 10 Drawing Figures

STRUCTURE OF DISPENSER FOR DISPENSING WEB-LIKE MATERIAL

BACKGROUND OF THE INVENTION

1. Field of the Invention

The present invention relates to an aperture in a wall of a dispenser for dispensing tearable, web-like material, such as, paper, plastic or metal foils, fabric or the like.

The invention further relates to a dispenser for dispensing such materials, incorporating at least one of the apertures according to the invention.

2. Discussion of the Prior Art

Dispenser apertures which facilitate not only drawing of material from dispensers, but also tearing off the length of material drawn, are known. The edges of these dispenser apertures are in all cases either serrated or grooved to produce teeth-like projections, or they constitute sharp knife edges. The disadvantages of such apertures and, thus, of dispensers incorporating such apertures, are obvious: they are dangerous to handle and may cause injury, if not during the tearing-off stage, then definitely when the fingers enter these apertures to grope for the end of the material and also when the fingers are withdrawn, having found the end of, and are now trying to pull out, the material. Another drawback of these known apertures is that their edges, either toothed or sharp, are mostly made of a different material. Thus, if the dispenser is made of cardboard, the active edge of the aperture is usually made of sheet metal, which causes added expenses, both for the metal edge itself, and for attaching the latter to the cardboard body of the dispenser. The disadvantage of known dispensers is, of course, implicit in their use of the known apertures.

SUMMARY OF THE INVENTION

It is the object of the invention to provide a dispensing aperture which is totally safe also in unskilled hands and has edges constituted by the material of the dispenser itself, even if made of such relatively soft materials as cardboard or the like. It is a further object of the invention to provide a dispenser incorporating the advantages of the aperture according to the invention.

These and other objects the invention achieves by providing an aperture in a wall of a dispenser for the dispensing tearable, web-like material, characterized in that said aperture has the form of a slot the active edges of which converge toward at least one end of said slot, whereby material drawn from said dispenser through said aperture and pulled toward said end is wedged tight between said converging slot edges and can be torn off, and also by providing a dispenser for tearable, web-like material, characterized in that it comprises at least one aperture provided with at least one pair of slot-forming edges which converge toward at least one end of said slot, whereby material drawn from said dispenser through said aperture and pulled toward said end is wedged tight between said converging slot edges and can be torn off.

BRIEF DESCRIPTION OF THE DRAWINGS

The invention will be more fully understood in connection with the following drawings which are meant to be illustrative only, and not by way of limitation. In the drawings.

DESCRIPTION OF THE PREFERRED EMBODIMENTS

The aperture according to the invention is also conceived for possible, but not necessarily exclusive, application in conjunction with a dispenser according to the co-pending Specification No. 21,315 teaching a dispenser for a material wound into a hollow, cylindrical, self-supporting roll, from which material could be drawn not only, in the conventional manner, from the outside, but also from the inside of the core-less roll.

Accordingly, such a dispenser would have to have at least two dispensing apertures, one on a wall adjacent to the circumference of the roll, to draw material from the outside of the roll (FIGS. 1–4), and one on a wall adjacent to an end face of the roll, to draw material from the inside of the roll (FIGS. 5–8).

Figure 2:
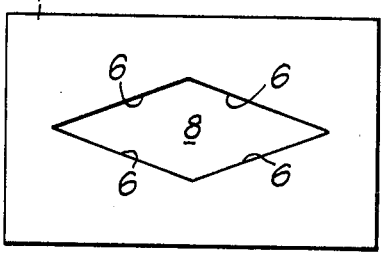
FIG. 1–9 show several, but by no means all, possible configurations of the aperture according to the invention.
Figure 1:
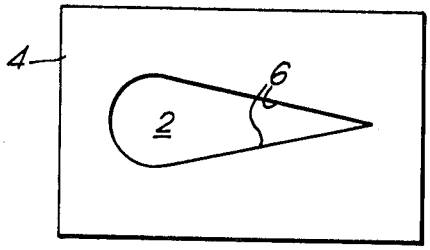

There is thus shown in FIG. 1 an aperture according to the invention, having the form of a slot 2 in a dispenser wall 4 adjacent to the circumference of the roll (not shown), the longitudinal edges 6 of which converge towards one end of the slot and are substantially rectilinear. Towards the other end, the slot 2 is wide enough for at least two fingers to reach through into the dispenser, in order to get hold of the material. When the material drawn from the dispenser is pulled toward the end of the slot 2, it is tightly wedged between the converging slot edges 6 and can easily be torn off. Pulling, after tearing, the paper in the opposite direction frees the wedged end, and releases the web. This feature is understood to be common to all possible configurations of the aperture according to the invention. FIG. 2 shows another embodiment of the aperture according to the invention, in the form of a slot 8 with two pairs of rectilinear edges 6 converging toward two ends, the widened section of the slot being in the center.

Figure 3:
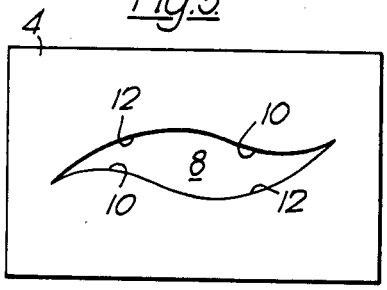

FIG. 3 shows a variant of the embodiment of FIG. 2, also having a slot 8 with edges converging towards two ends. These edges are, however, not rectilinear, the edges 10 being convex, and the matching edges 12 being concave.

Figure 4:
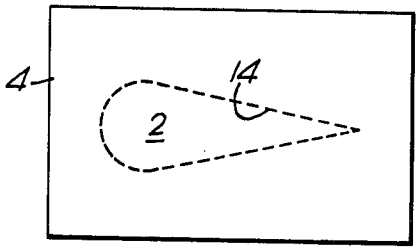

For reasons of hygiene or in order to make the dispenser tamperproof until used, it is advantageous to supply the dispenser with the aperture sealed. FIG. 4 shows the wall 4 of such a dispenser, in which the aperture, in this embodiment similar to the slot 2 of FIG. 1, is opened up, prior to first use, by the user himself, who tears out the aperture along the weakening or perforated line 14 provided.

Figure 5:
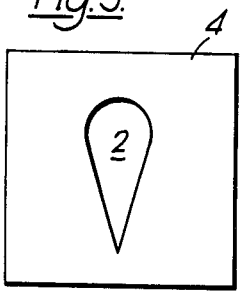
Figure 6:
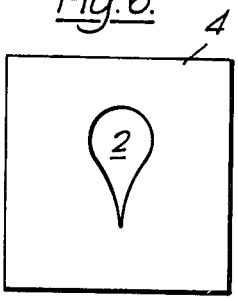
Figure 7:
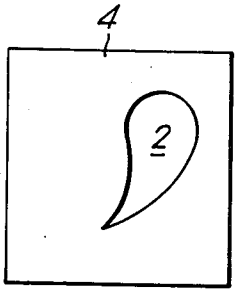

As the dispensers incorporating the aperture according to the invention preferably dispense tearable, web-like material in the form of hollow, cylindrical, coreless, self-supporting rolls permitting drawing of material also from the inside of the rolls, appropriate apertures can also be provided on walls adjacent to the end faces of the roll, facilitating the drawing of material from the inside of the roll. FIGS. 5 to 7 show such apertures with edge configurations similar to those shown in FIGS. 1 to 3.

Figure 8:
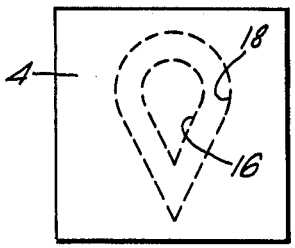

FIG. 8 shows the end wall of a dispenser, in which the dispensing aperture is sealed, similar to that shown in FIG. 4, to be opened up by the user himself, who tears out the aperture along the weakening or perforated line 16. As, through drawing material from its inside, the internal diameter of the roll steadily increases, the size of the aperture delineated by the weakening or perforated line 16 might in the course of use become uncomfortably small, in which case a second weakening or perforated line 18 permits the aperture to be enlarged.

Figure 9:
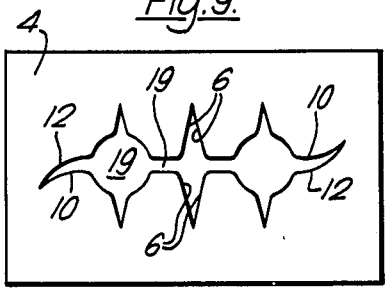

In FIG. 9 there is shown a further possible embodiment in which the aperture 19 is provided with a multiplicity of pairs of slot-forming converging edges 6 to enable the user to pull and tear material via any of said pairs of edges. As also seen, there are provided more than one wide zone allowing to reach through into the dispenser's wall 4 in order to get hold of the material.

For use with relatively tough materials, such as, certain fabrics or plastic foils, a part of the aperture edges may be toothed or sharp, without impairing the aforementioned safety properties of the aperture according to the invention, as such teeth or knife edges would be required only close to the wedging end of the aperture, leaving especially the widened section of the aperture completely safe.

Figure 10:
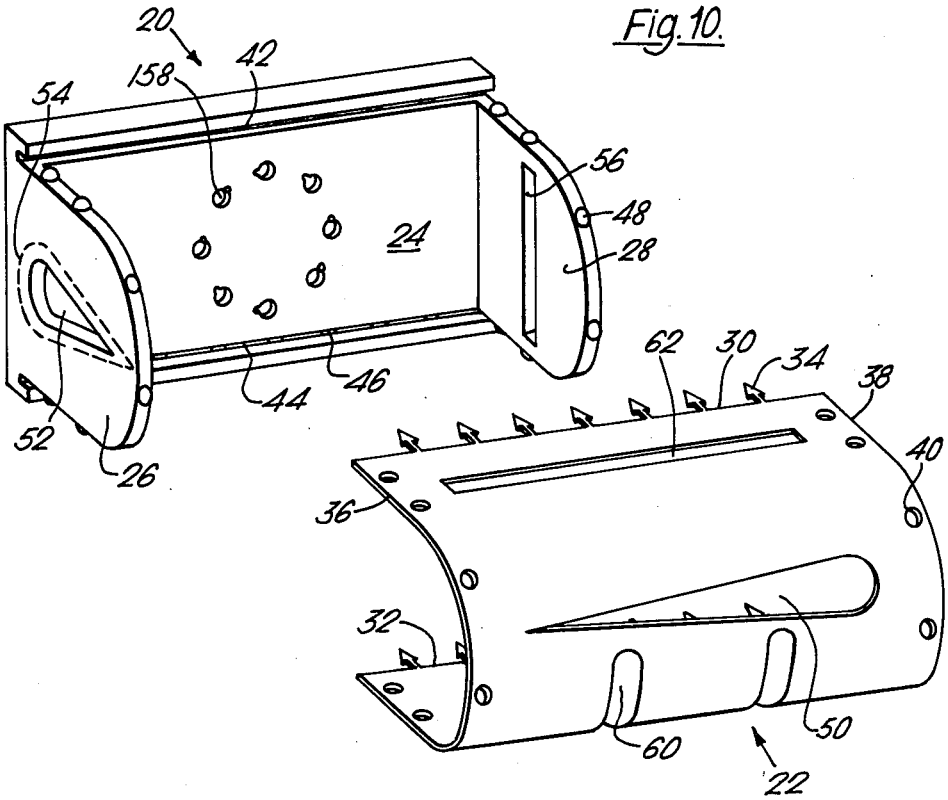
FIG. 10 shows an application of the aperture according to the invention in a dispenser.

FIG. 10 shows an exploded view of a preferred embodiment of the dispenser according to the invention, consisting of two parts, a U-shaped carrier 20 and a bendable sheet 22 attachable at the free edges of the carrier 20. The yoke 24 forms the backwall, and the wings 26 and 28 form the side walls of the dispenser. The (not shown) material roll is partly wrapped in the flexible sheet 22, which latter is then attached to the carrier 20. For this purpose there are provided, on the opposite edges 30 and 32 of the sheet 22, a plurality of arrow-head-like projections 34 and, on the other edges 36 and 38, a plurality of holes 40. Upon assembly, the two edges 30 and 32 are introduced into grooves 42 and 44 provided at the two free edges of the yoke 24, the projections 34 snapping into, and is caught in, passages 46 leading to the back side of the yoke 24. The holes 40 are made to engage on projections 48 provided on the edges of the wings 26 and 28. When the roll is used up, the flexible sheet 22 is ripped off the carrier 20, in which process the arrow heads 34 are turn off. The used sheet 22 is thus thrown away, while the carrier 20 is reusable. A new roll is then introduced, inside a new, bent sheet 22. The sheets 22 are preferably sold together with the material rolls, the former serving as wrapping for the latter.

The sheet 22 is provided with a dispensing aperture 50 through which the material unwindable from the outside of the roll is drawn. The aperture 50 of this preferred embodiment is similar in shape and properties to the aperture shown in FIG. 1 and described hereinbefore, but could conceivably be of any other suitable shape.

The carrier wing 26, adjacent to one of the ends of the roll, is provided with a dispensing aperture 52 through which passes the axis of the material roll. This aperture is similar to that shown in FIG. 5 and is provided with weakening or perforated line 54 enabling the aperture 52 to be enlarged (see weakening or perforated line 18 in FIG. 8 and the related explanations).

The carrier wing 28 is provided with a slot-like window 56. On the outer side of the wing 28 (not visible in the drawing) there are provided, on two sides along the window 56, two scales (not shown). One scale shows at the upper end of the window 56, at the point where the upper part of the circumference of the full roll would come to lie, the value 100%, and, at a lower point of the window 56, at the point where the upper part of the circumference of the almost consumed roll would come to lie, the value 0%. The other scale has the value zero at the lower end of the window and the value 100% at a more central point of the window 56. The relative thickness of the available material roll can be read off one or the other scale, depending on whether the material was drawn from the outside or from the inside of the roll.

The carrier yoke 24 is provided with several pairs of holes 58 facilitating hanging of the dispenser in a horizontal, vertical or oblique position, using two nails to be driven into a wall.

The flexible sheet 22 of this embodiment has two embossed beads 60, on whose convex sides rests the material roll inside the dispenser. This reduces the area of contact of the material roll with the sheet 22, reducing the frictional resistance encountered by the rotating roll when material is drawn off its outside. For particularly large and heavy rolls which would be hard to rotate even after provision of these beads 60, roller means can be provided in the dispenser, on which to mount such rolls.

A slot 62 is provided on the upper side of the sheet 22, the longitudinal edges of which slot are parallel to the axis of the material roll. This slot 62 serves for the possible introduction of a second web-like material, for instance a fabric, into the dispenser. The second material may be drawn from a second dispenser, arranged above the first dispenser. These two web-like materials, for instance, a detergent-impregnated fabric and an absorbent paper, can then be drawn together from the dispensing slot 50 of the first dispenser.

The arrow-head fastening means 34 of the sheet 22 are mentioned by way of example only. Any other fast-acting connection means may be used as well.

While particular embodiments of this invention have been described, it will be evident to those skilled in the art that the present invention may be embodied in other specific forms without departing from the essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. In a dispenser apparatus for tearable web-like material, the improvement comprising:

an aperture in a wall of the dispenser, said aperture having a plurality of zones wide enough for at least two fingers simultaneously to reach through said zones and into the dispenser to grasp the material and a plurality of slots, the edges of each of said slots converging in a sharp angle at an apex; and the material being a continuous, hollow, cylindrical roll drawable through said zones and toward said apex; whereby individual pieces of said material of a desirable length may be detached from said roll of material when pulled toward said apex.

2. The dispenser of claim 1, wherein said plurality of zones comprises 3 zones and said plurality of slots comprises 8 slots.

3. In a dispenser apparatus for tearable web-like material, the improvement comprising:

an aperture in a wall of the dispenser, said aperture having a single zone wide enough for at least two fingers simultaneously to reach through said zone and into the dispenser to grasp the material and a single slot, the edges of said slot converging in a sharp angle at an apex; and the material being a continuous, hollow, cylindrical roll drawable through said zone and toward said apex; whereby individual pieces of said material of a desirable length may be detached from said roll of material when pulled toward said apex.

4. The dispenser of claim 3, wherein both of the converging edges of said slot are curved.

5. The dispenser of claim 3, wherein both of the converging edges of said slot are curved inwardly.

6. The dispenser of claim 3, wherein one of the converging edges of said slot is curved inwardly and the other edge of the slot is curved outwardly.

7. The dispenser of claim 3, wherein there is further provided perforations surrounding the aperture defining an outline configurationally corresponding to and equidistant from the aperture.

8. In a dispenser apparatus for tearable web-like material, the improvement comprising:

a perforated section in a wall of the dispenser apparatus, tearable along the perforated section to form an aperture, said aperture having a single zone wide enough for at least two fingers simultaneously to reach through said zone and into the dispenser to grasp the material and a single slot, the edges of said slot converging in a sharp angle at an apex; and the material being a continuous, hollow, cylindrical roll drawable through said zone and toward said apex; whereby individual pieces of said material of a desirable length may be detached from said roll of material when pulled toward said apex.

9. The dispenser of claim 8, wherein a perforated outline is provided in the wall of the dispenser surrounding said perforated section tearable along said perforated outline to form an opening larger than and configurationally corresponding to said perforated section or aperture formed by removal of said perforated section.

10. The dispenser of claim 3 or claim 8, wherein the cylindrical roll is in the form of a coreless, self-supporting roll having two end faces.

11. The dispenser of claim 10, having two walls adjacent the end faces of said coreless, self-supporting roll and wherein at least one of the two walls of said dispenser adjacent the end faces of said roll is provided with an aperture, through which aperture, the material, drawable from the inside of said cylindrical roll, can be drawn from said dispenser.

12. The disepenser of claim 13, or claim 8, further comprising: a first base member forming the back and side walls of the dispenser and enclosing said cylindrical roll, the forward edges of said side walls having a U-shaped configuration; and a second member forming the top, front and bottom walls of the dispenser, said second member configurationally corresponding to and engaging the U-shaped side walls.

13. The dispenser of claim 12, wherein the edges of the second member are provided with fastening means adapted to engage securing means in said first member corresponding in position to said fastening means.

14. The dispenser of claim 13, or claim 8, wherein at least one of the wall adjacent to the circumference of the cylindrical roll is provided with a receiving slot extending parallel to the axis of the cylindrical roll in such manner that a second web-like material from a second dispenser is introduceable into said receiving slot and dispensible from said aperture with the material from the first dispenser.

* * * * *